US007142681B2

(12) United States Patent
Kortekaas

(10) Patent No.: US 7,142,681 B2
(45) Date of Patent: Nov. 28, 2006

(54) DEVICE AND METHOD TO REMOTELY OPERATE A HEARING DEVICE

(75) Inventor: Reinier Kortekaas, Erlangen (DE)

(73) Assignee: Siemens Audiologische Technik GmbH, Erlangen (DE)

( * ) Notice: Subject to any disclaimer, the term of this patent is extended or adjusted under 35 U.S.C. 154(b) by 197 days.

(21) Appl. No.: 10/777,834

(22) Filed: Feb. 12, 2004

(65) Prior Publication Data

US 2004/0179708 A1 Sep. 16, 2004

(30) Foreign Application Priority Data

Feb. 12, 2003 (DE) ..... 103 05 830

(51) Int. Cl.
*H04R 25/00* (2006.01)
*G09G 5/00* (2006.01)

(52) U.S. Cl. ..... 381/315; 345/168

(58) Field of Classification Search ..... 381/315, 381/312, 329; 345/168, 175, 169, 170, 173, 345/174; 382/106; 341/20, 21, 22, 23, 26; 400/472, 479

See application file for complete search history.

(56) References Cited

U.S. PATENT DOCUMENTS 6,512,838 B1 * 1/2003 Rafii et al. ..... 382/106
6,611,252 B1 * 8/2003 DuFaux ..... 345/168
6,816,600 B1 * 11/2004 Jakob et al. ..... 381/315

FOREIGN PATENT DOCUMENTS

DE 100 48 338 A1 4/2002

OTHER PUBLICATIONS

Mitarbeiterzeitschrift "Siemens Welt", Ausgabe Oct. 2002, Seite 4, Artikel "Virtuelle Keyboard"; English Translation attached.

* cited by examiner

*Primary Examiner*—Sinh Tran
*Assistant Examiner*—Brian Ensey
(74) *Attorney, Agent, or Firm*—Schiff Hardin LLP

(57) ABSTRACT

The manual operation of hearing devices is simplified using a remote control that provides a projection device in order to project virtual buttons on a back of a hand. A sensor device registers, as necessary, an operation of the virtual buttons, whereupon a corresponding control signal is wirelessly transmitted to the hearing device. Very large buttons can thereby specially be made available for older patients or those who are dexterilly challenged.

15 Claims, 1 Drawing Sheet

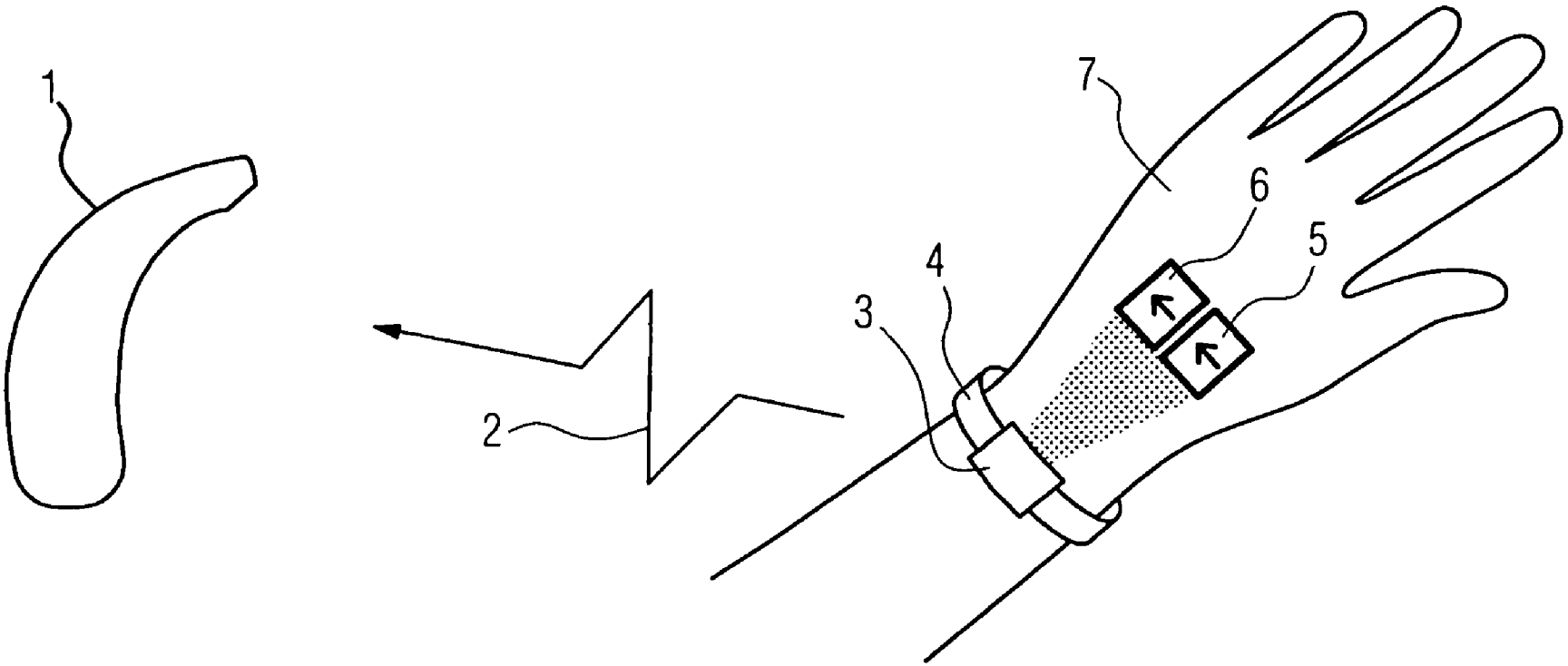
1
2
3
4
5
6
7

DEVICE AND METHOD TO REMOTELY OPERATE A HEARING DEVICE

BACKGROUND OF THE INVENTION

The present invention concerns a device to remotely operate a hearing device with an input device for manual input of control data. Furthermore, the present invention concerns a corresponding method for remote operation of a hearing device.

As is generally known, the majority of the users of hearing devices are older people. However, with increasing age, actions of a fine-motor type become ever more difficult. This results in, for example, the operation of a loudspeaker controller or an auditory program switch on the hearing device being difficult or even impossible for many older people. Larger-designed controllers or switches are, however, normally not possible due to a shortage of space on the shell of an in-the-ear hearing device or, respectively, on the housing of a behind-the-ear hearing device.

As a remedy for this, remote controls with buttons are used. The motor operations can thus be visually monitored by the hearing device user himself. However, this is difficult because one normally desires the remote control to be as small as possible for reasons of design and production costs. In contrast, the fine motor control decreasing with age makes the operation of small buttons difficult, resulting in the problem cited above. A small remote control can additionally easily be lost.

SUMMARY OF THE INVENTION

The object of the present invention is thus to simplify the operation of hearing devices, in particular for older hearing device users.

From the field of mobile radio, "virtual keyboards" (as they are specified in the magazine "Siemens Welt", issue 10/2002, page 4) are known for operation of mobile radio telephones or handhelds. These virtual keyboards primarily serve to enable an SMS or, respectively, short message to be created rapidly. Given such a virtual keyboard, a light image of the keyboard is projected on a surface such as a table. The finger movements of the user on this virtual keyboard are detected by way of a light-sensitive sensor and converted into corresponding operations.

Based on this, the object cited above is inventively achieved via a device to remotely operate a hearing device with an input device to manually input control data, whereby the input device comprises a projection device to project virtual input elements and a sensor device to register an operation of the virtual input elements.

Furthermore, a method is inventively provided to remotely operate a hearing device via manual input of control data, as well as to project virtual input elements and register an operation of the virtual input elements given manual inputs.

In preferred embodiments of the invention, the virtual input elements comprise images of buttons, rotary switches and/or sliding switches. Control information can thereby be quasi-continuously or discretely input into the remote control. The virtual input elements can especially comprise an image of a program selection switch and/or a loudspeaker controller.

The virtual input elements are advantageously projected on the back of a hand with a projection device. Such a projection on the hand or, respectively, the back of the hand, offers the advantage that both the fingertip and the back of the hand are used for the operation. Both are relatively sensitive with regard to contacts. Relative to the conventional, physical button—operated with only the fingertip—this means that a greater sensory-motor stimulation is felt, and thus a better control, since the contact is doubly felt.

The virtual input elements are preferably scalable in size. They can therewith be adapted to the preferences or, respectively, requirements of the individual hearing device user. This is not practically realizable given conventional, physical buttons.

The projection direction can be freely programmable with regard to the projected information. In addition to buttons or, respectively, controllers, information about the state of the hearing device can thus be projected for representation for the hearing device user. Via this fundamentally free programmability, the hearing device can likewise be exceptionally adapted to the preferences or, respectively, requirements of the individual hearing device user.

An embodiment of the inventive device to remotely operate a hearing device or, respectively, its input device can, for high availability, be integrated into a ring, a wristband or a wristwatch. The danger of losing the remote control is thus less than in the case of an independent device.

An embodiment of the inventive device advantageously possesses only a single physical control element for its activation. A single activation button can be selected correspondingly large, such that it normally works for each hearing device user to activate the remote control.

DESCRIPTION OF THE DRAWINGS

Embodiments of the invention are explained in detail below using the attached drawing, which shows a principle drawing of the use of an embodiment of the inventive device.

DETAILED DESCRIPTION OF THE PREFERRED EMBODIMENTS

The subsequently specified embodiment represents a preferred exemplary embodiment of the present invention.

A hearing device 1 is shown in the Figure that possesses a receiver and, as the case may be, a transmitter for wireless transmission 2 of control signals. The control signals are emitted by a remote control 3 that is equipped with a transmitter and, as the case may be, a receiver for the wireless transmission of control signals.

The remote control 3 is attached to a wristband 4 that can be attached to a wrist. The remote control 3 projects two virtual buttons 5 and 6 on the back 7 of the hand of the hearing device user. For example, the volume can be regulated higher and lower with these virtual buttons 5 and 6. Alternatively, the buttons "1", "2" and "T" of a program switch for the hearing device can also projected on the back 7 of the hand.

A contact of the hand or, respectively, of the back 7 of the hand at the location at which a virtual button 5, 6 is projected is registered by a sensor that is integrated into the remote control 3 and triggers a control signal. Thus, for example, in the case of the operation of the button "higher" of the volume control, a corresponding signal would be transmitted from the remote control 3 to the hearing device 1, and the amplification would be increased in the hearing device.

The remote control 3 may be equipped with an on/off switch that has a relatively large area, however it is not shown in the Figure.

With the aid of the remote control 3, status information about the hearing device can be projected on the back 7 of the hand. This information can concern setting parameters of the hearing device 1 or even the charge state of the hearing device battery and the like. This information can be evoked either by operating corresponding virtual buttons or the on/off switch cited above that, in this case, can be fashioned as a multiswitch.

For the purposes of promoting an understanding of the principles of the invention, reference has been made to the preferred embodiments illustrated in the drawings, and specific language has been used to describe these embodiments. However, no limitation of the scope of the invention is intended by this specific language, and the invention should be construed to encompass all embodiments that would normally occur to one of ordinary skill in the art. The present invention could employ any number of conventional techniques for electronics configuration, signal processing and/or control, data processing and the like. The particular implementations shown and described herein are illustrative examples of the invention and are not intended to otherwise limit the scope of the invention in any way. For the sake of brevity, conventional electronics, control systems, software and other functional aspects of the systems (and components of the individual operating components of the systems) may not be described in detail. Furthermore, the connecting lines, or connectors shown in the various figures presented are intended to represent exemplary functional relationships and/or physical or logical couplings between the various elements. It should be noted that many alternative or additional functional relationships, physical connections or logical connections may be present in a practical device. Moreover, no item or component is essential to the practice of the invention unless the element is specifically described as "essential" or "critical". Numerous modifications and adaptations will be readily apparent to those skilled in this art without departing from the spirit and scope of the present invention.

REFERENCE LIST

1 hearing device
2 wireless transmission
3 remote control
4 wristband
5, 6 virtual buttons
7 back of the hand

What is claimed is:

1. A device to remotely operate a hearing device, comprising:

an input device integrated into a wristband or wristwatch and is configured to manually input control data, the input device comprising:

a projection device configured to project one or more virtual input elements onto a surface of a human body that is a back of a hand; and a sensor device configured to register an operation of the virtual input elements.

2. The device according to claim 1, wherein the one or more virtual input elements comprises at least one of images of buttons, rotary switches and sliding switches.

3. The device according to claim 1, wherein the one or more virtual input elements comprise at least one of images of buttons of a program switch and a loudspeaker control.

4. The device according to claim 1, wherein the virtual input elements are scalable in size.

5. The device according to claim 1, wherein the projection device is configured to be freely programmable with regard to the projected information.

6. The device according to claim 1, further comprising an activation device as a single physical control element of the device.

7. The device according to claim 1, wherein the input device further comprises a wireless transmitter configured to transmit control signals based on information obtained from the sensor device to the hearing device.

8. The device according to claim 1, wherein all of the virtual input elements are configured to be projected with the projection device simultaneously onto the surface of the human body.

9. A method to remotely operate a hearing device, comprising:

projecting, with a device integrated into a wristband or wristwatch, one or more virtual elements onto a surface of a human body which is a back of a hand;

manually inputting information via the one or more virtual elements, thereby registering an operation;

converting registered operation data to control signals; and communicating the control signals to the hearing device.

10. The method according to claim 9, further comprising registering the operation of the one or more virtual input elements quasi-continuously or discretely.

11. The method according to claim 9, further comprising adjusting a program or a loudspeaker of the hearing device with the input device.

12. The method according to claim 9, further comprising individually adapting a size of the one or more virtual input elements.

13. The method according to claim 9, further comprising freely programming the information to be projected.

14. The method according to claim 9, further comprising invoking the method by operating a physical activator.

15. The method according to claim 9, wherein all of the virtual input elements are simultaneously projected onto the surface of the human body.

* * * * *